US006345406B1

(12) United States Patent
Dodd

(10) Patent No.: US 6,345,406 B1
(45) Date of Patent: Feb. 12, 2002

(54) ORAL HEALTHCARE SYSTEM HAVING INTERCHANGEABLE, DISPOSABLE HEADS

(76) Inventor: William A. Dodd, 2815 Parrish St., Philadelphia, PA (US) 19130

( * ) Notice: Subject to any disclaimer, the term of this patent is extended or adjusted under 35 U.S.C. 154(b) by 0 days.

(21) Appl. No.: 09/457,444

(22) Filed: Dec. 8, 1999

(51) Int. Cl.[7] ..... A46B 9/04

(52) U.S. Cl. ..... 15/176.1; 15/167.1; 15/143.1

(58) Field of Search ..... 15/143.1, 145, 15/106, 110, 167.1, 176.1, 176.6; 16/422; 132/308–310; 403/315, 316, 292, 326; 433/31, 147

(56) References Cited

U.S. PATENT DOCUMENTS 4,395,943 A * 8/1983 Brandi ..... 15/167.1
4,683,604 A * 8/1987 Rueb ..... 15/145
4,888,844 A * 12/1989 Maggs ..... 15/167.1
5,010,906 A * 4/1991 Preciutti ..... 15/167.1
5,058,230 A * 10/1991 Hodosh et al. ..... 15/167.1
D336,368 S 6/1993 Bickell
5,253,948 A * 10/1993 Butler ..... 15/176.6
D344,414 S 2/1994 Rahman
5,373,599 A * 12/1994 Lemon et al. ..... 15/167.1
5,438,726 A * 8/1995 Leite ..... 15/167.1
5,749,381 A 5/1998 Butler et al.
5,781,958 A * 7/1998 Meessmann ..... 15/167.1
5,850,659 A 12/1998 Butler et al.
5,851,116 A * 12/1998 Margolis ..... 15/167.1
5,875,510 A * 3/1999 Lamond et al. ..... 15/167.1
5,881,425 A * 3/1999 Hudson et al. ..... 15/167.1
6,006,394 A * 12/1999 Bredall et al. ..... 15/167.1
6,145,152 A * 11/2000 Ward ..... 15/167.1

* cited by examiner

*Primary Examiner*—Terrence R. Till
(74) *Attorney, Agent, or Firm*—Susan B. Evans

(57) ABSTRACT

Disclosed herein is an oral healthcare system having interchangeable, detachable, disposable heads. The heads include but are not limited to brushhead, mirror head and tongue cleaner head. The system will also accommodate specialized heads including but not limited to an interdental brush head, oversize brush head, implant brush head, gum brush head, denture brush head, gum stimuli head, and ortho brush head. The present invention has a unique head and handle assembly which provides a firm backbone support framework for the head.

16 Claims, 11 Drawing Sheets

ORAL HEALTHCARE SYSTEM HAVING INTERCHANGEABLE, DISPOSABLE HEADS

BACKGROUND OF INVENTION

1. Field of Invention

The present invention relates to an oral healthcare system having interchangeable, detachable, disposable heads. More particularly, the invention relates to an oral care system with three main heads, a toothbrush head, a tongue cleaner head and a mirror head. The system will also accommodate specialized heads which include an interdental brush head, an oversize brush head, an implant brush head, a gum brush head, a denture brush head, a gum stimuli head, and an ortho brush head for completely attending to one's daily and specialized oral hygiene.

2. Description of the Prior Art

Prior to the present invention, no practical and economical oral care system existed that was commercially available where a person could purchase the complete system tailored to his oral care needs that had everything the person needed between check ups for properly caring for his permanent teeth, dentures, partials and/or retainers. More and more people are being educated concerning proper hygiene for the teeth and gums, especially in the United States. Since people are now living longer, there is a need to maintain your teeth and gums longer. Hence, people are attempting to be proactive concerning their teeth so that they may serve them longer.

A number of assemblies exist in the prior art that have detachable heads from their handles. For example, U.S. Pat. No. 5,749,381 and 5,850,659 of Butler et. al. are directed to toothbrushes with interchangeable heads that are bendable and/or rotateable as desired for achieving what is the best angle for brushing. This toothbrush has an oversized handle and interchangeable, flexible heads of different sizes, bristles arrangements, and geometrical configurations. U.S. Pat. No. 5,617,884 of Allison is another example of a toothbrush with removable heads.

U.S. Design Pat. No. 344,414 shows an ornamental design for a toothbrush with a disposable head. It appears that the bristles are pushed out of the head with the thumb from the back of the head and presumably replaced with another cartridge of bristles. U.S. Design Pat. No. 366,368 shows an ornamental design for a toothbrush with a detachable head, which appears to have a spring loaded button that locks the head onto the handle and presumably removes the head by the same button.

None of this prior art discloses the present invention.

SUMMARY OF THE INVENTION

The oral healthcare system of the present invention creates improved oral hygiene as it enables the user to brush his/her teeth, clean his/her tongue, and with the aid of the mirror head and a secondary mirror (that may be the bathroom mirror), by use of indirect vision, to observe the teeth and gums in the oral cavity to review any inconsistency that the user may believe exists. This oral care system of the present invention relates to a toothbrush having interchangeable, detachable, disposable heads comprising a) an ergonomically shaped handle with a neck end and a butt end, a front side and a back side, where the neck end tapers into an elongated stem, on the front and back sides of the handle a distance from the stem a locking nodule is located integrated with stopping means, and on the back side of the handle a gripping means for securely holding the handle during its use, and b) an interchangeable head with a front side and back side where toothbrush bristles are located on the front side and as an integral part thereof a recessed, elongated cavity suitable for receiving and seating the tapered elongated stem therein to form a firm backbone support framework for the handle and locking slots on the front and back sides of the head for receiving and securing the locking nodules of the handle to the head.

The present invention further is directed to an oral care system using the toothbrush noted above and at least two other interchangeable heads of a mirror head and a tongue cleaner head.

The system also accommodates specialized heads for orthodontics, periodontics, implants, dentures and bridgework.

BRIEF DESCRIPTION OF THE DRAWINGS

These as well as other features of the present invention will become more apparent upon reference to the drawings wherein.

DETAILED DESCRIPTION OF THE INVENTION

Figures 1, 2:
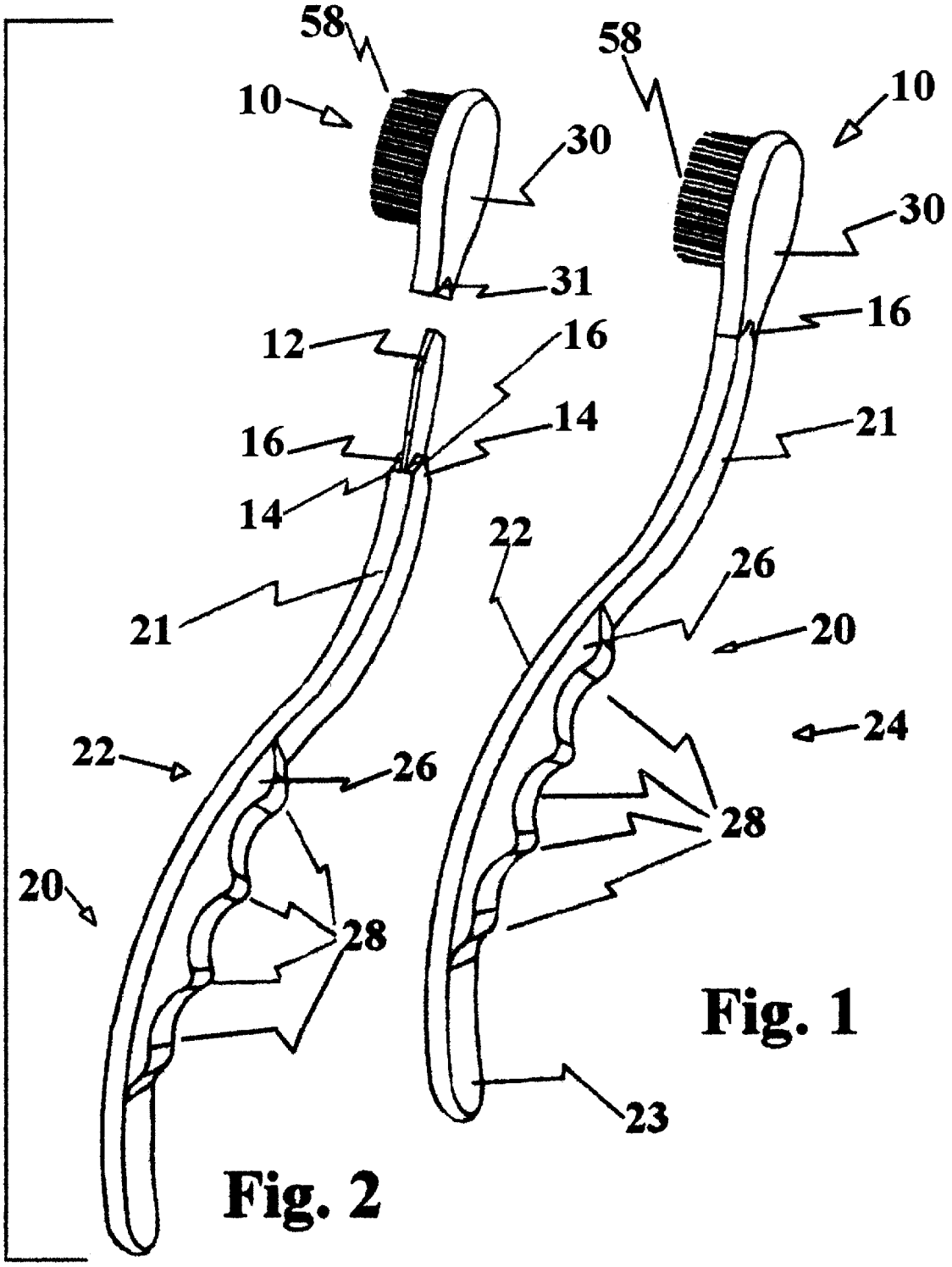
FIG. 1 is a side view of the oral healthcare system of the present invention
FIG. 2 is a side view of the unconnected sections of the handle and head of the oral healthcare system of the present invention.

It was surprisingly found that there was no commercial oral care system that was a simple design that was economical to purchase and replace yet was environmentally friendly.

Referring to the drawings, FIGS. 1–15 illustrate an oral healthcare system having interchangeable, detachable, disposable heads referred to by the general reference character 10.

The present invention 10 is primarily directed for use of the general public that may have various problems or needs for their oral care. This system can be adapted for regular routine dental care or for specialized needs such as for orthodontics, periodontics, implants, dentures and bridgework (also referred to herein as interdental).

The principal design is a toothbrush that has a handle 20 with a grip 26 and a detachable brushhead 34. The brushhead 34 can easily be interchanged with a tongue cleaner head 36 and a mirror head 38. The handle 20 of the present invention has a stem 12 portion that fits securely into a recessed elongated cavity 32 in the head 30 and is further secured therein by a locking nodule 16 located integrated with stopping means 14.

FIGS. 1 and 2 illustrate the oral healthcare system 10 of the present invention. They show an ergonomically shaped handle 20 with a neck end 21 and a butt end 23, a front side 22 and a back side 24, the neck end 21 having a tapered elongated stem 12, and an interchangeable head 30 (i.e. brushhead 34) with a front side and back side where toothbrush bristles 58 are located on the front side having as an integral part thereof a recessed elongated cavity 32 suitable for receiving and seating the tapered elongated stem 12 therein to form a firm backbone support framework for the handle 20 and locking slot 31 on the front and back sides of the head 30 for receiving and securing the locking nodule 16 of the handle 20 to the head 30.

The stopping means 14 is elevated above the stem 12. It serves as a stop mechanism between the stem 12 and the head 30 and is integrated with locking nodule 16 which locks the head 30 into place. The head 30 has a corresponding element, locking slot 31 to receive the locking nodule 16 at the entrance to the recessed elongated cavity 32. The head 30 is interchangeable with the various functional heads i.e. brushhead 34, tongue cleaner head 36, mirror head 38. (see FIGS. 6–8) The system also accommodates specialized heads for orthodontics, periodontics, implants, dentures and bridgework. (see FIGS. 9–15)

"The handle 20 of the present invention has a curvature therein to conform with the curvature of a user's hand. The curvature of the handle exists on 2 planes, a first plane which includes the stem 12 and head 30 and a second plane which includes the handle 20, wherein the curvature of the first plane slopes towards the bristles (or front side) 22 of the toothbrush and a second plane which slopes away from the bristles (or front side) of the toothbrush. Further, the backside 24 of the handle 20 has a rubber or rubber like gripping means 26 fitting along said curvature. The purpose of the curvature and the gripping means 26 is to facilitate a firm and comfortable grip of the handle 20 by the user. The gripping means 26 has a plurality of ridges 28 for seating the fingers of a user's hand in a wrapping around securing grip. The gripping means 26 can be made of a number of materials well known in the art, preferably rubber."

Figure 3:
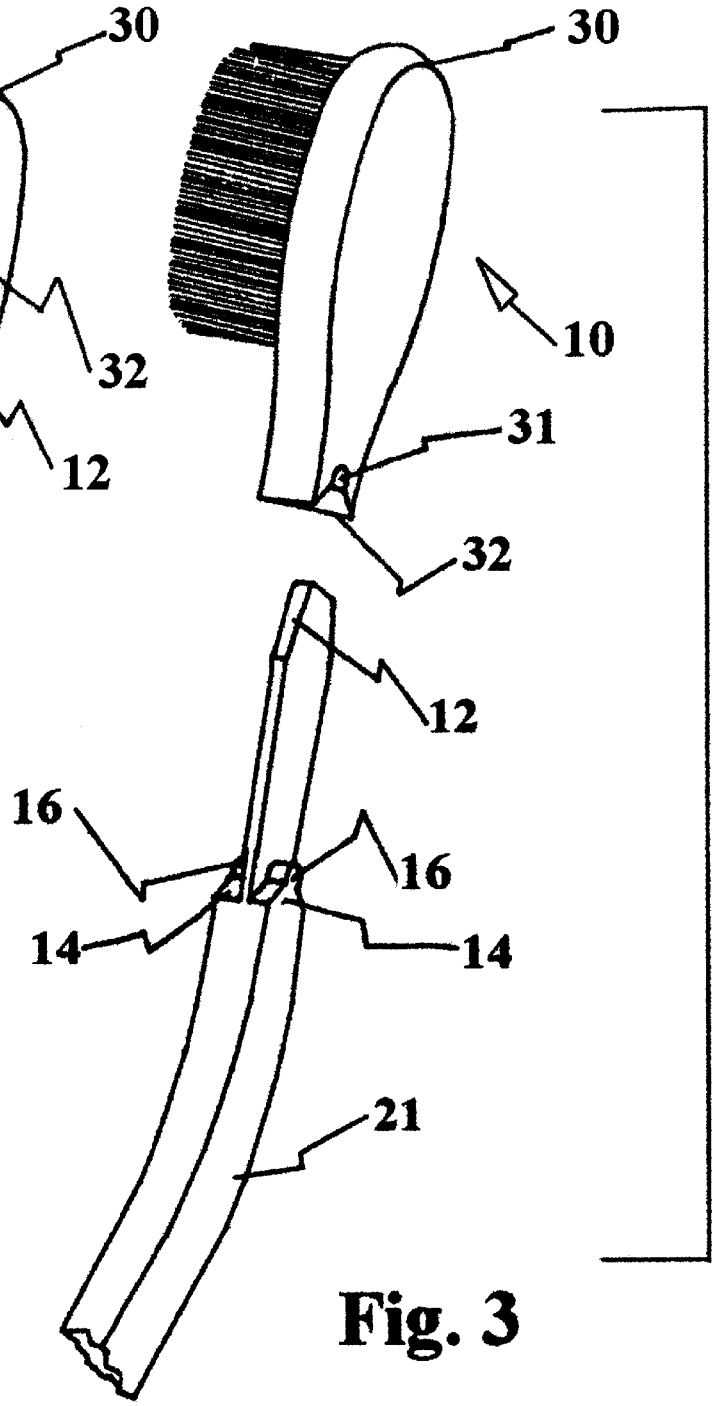
FIG. 3 is a cut away partial view of the unconnected sections of the top of the handle and head of the present invention illustrating the stem and stop mechanism.

FIG. 3 illustrates a cut away partial view of the unconnected sections of the neck end 21 of the handle 20 and head 30 of the present invention illustrating the tapered stem 12, locking nodule 16 and stopping means 14. It also illustrates a locking slot 31 in the head 30 which corresponds to and receives the locking nodule 16 and serves to lock the stem 12 and head 30 together.

Figure 4:
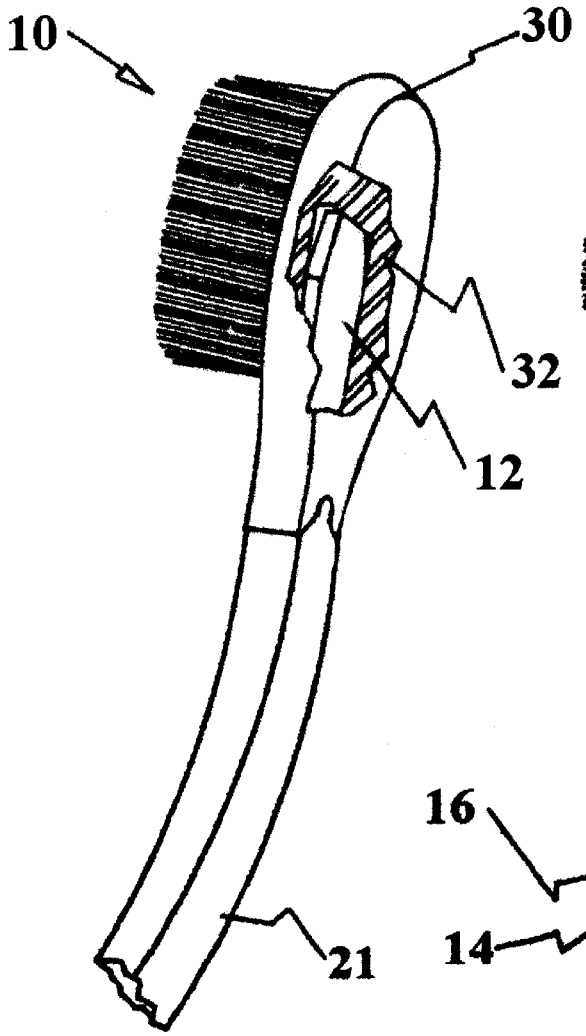
FIG. 4 is an exploded view of the head of the oral healthcare system of the present invention illustrating the stem secured in the recessed elongated cavity of the head.

FIG. 4 is an exploded view of the head 30 of the oral healthcare system of the present invention illustrating the stem 12 secured in the recessed elongated cavity 32 of the head 30. When the stem 12 is secured in the recessed elongated cavity 32 a firm backbone support framework for the handle 20 is provided. This framework when connected keeps the handle 20 and head 30 from disengaging or from swiveling around in the hand of the user.

Figure 5:
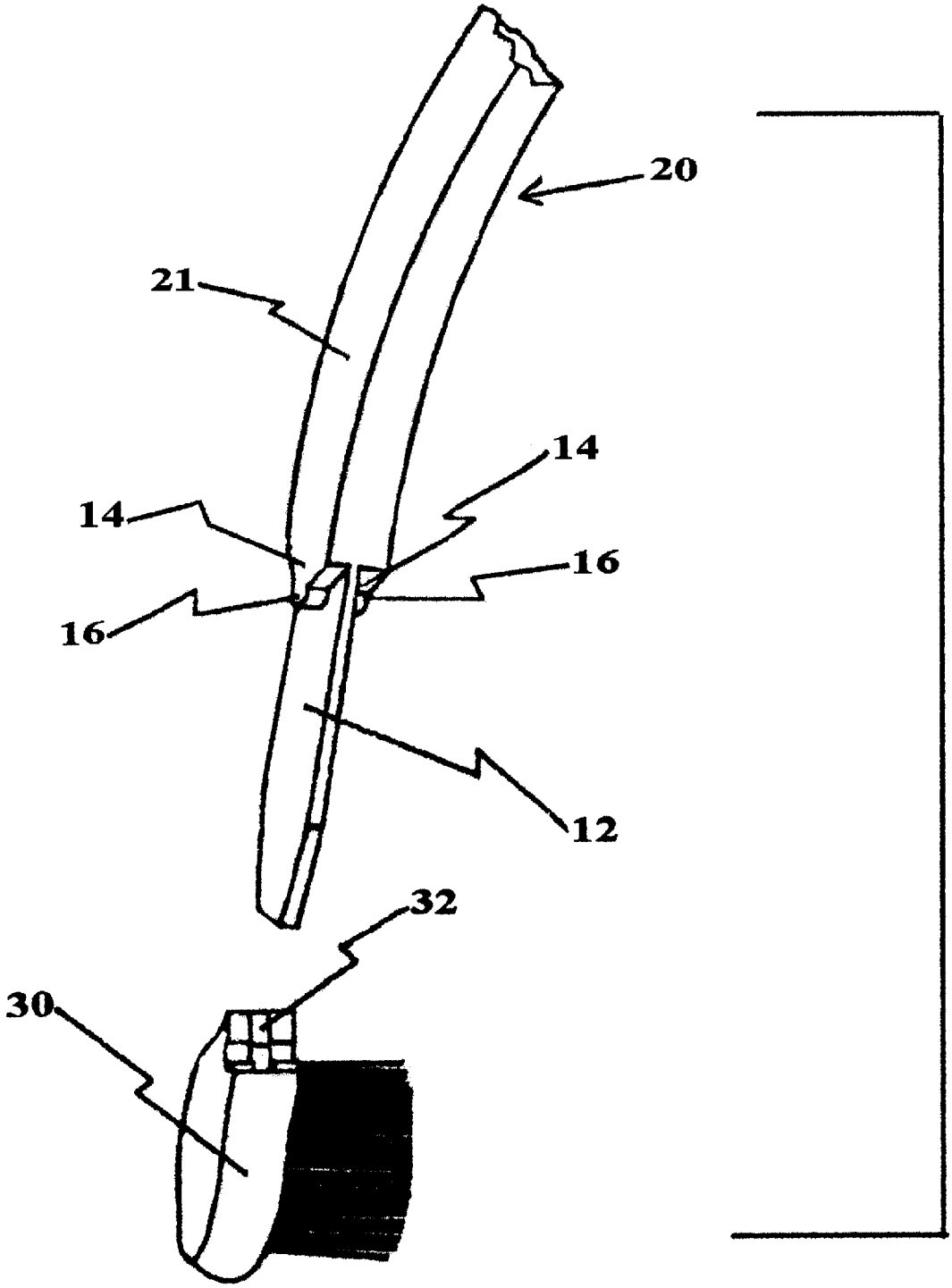
FIG. 5 is a cut away side view of the unconnected brushhead and handle of the present invention illustrating the stem and the entrance to the recessed elongated cavity of the head.

FIG. 5 is a cut away side view of the unconnected head 30 and handle 20 of the present invention illustrating the stem 12 and the entrance to the recessed elongated cavity 32 of the head.

FIGS. 6–15 illustrate several heads including the brushhead 34, the tongue cleaner head 36 and the mirror head 38 as well as specialized heads including but not limited to an interdental brush head 41, an oversize brush head 42, an implant brush head 43, a gum brush head 44, a denture brush head 45, a gum stimuli head 46 and an ortho brush head 47. Any combination of the brushhead 34 and any two, three, four or more of the other interchangeable heads may be assembled in the oral care system. A preferred assembly of the oral care system has the brushhead 34 and at least two other interchangeable heads of a mirror head 38 and a tongue cleaner head 36. Another preferred assembly of the oral care system has the brushhead 34 and at least two other interchangeable heads of a mirror head 38, a tongue cleaner head 36, interdental brush head 41, oversize brush head 42, implant brush head 43, gum brush head 44, denture brush head 45, gum stimuli head 46, and ortho brush head 47.

The heads 30 are composed of any of a number of materials well known in the art, preferably nylon bristles which may be conformed of various firmness (soft, medium and firm), rubber tips for the tongue cleaner head and gum stimuli head and any of a variety of reflective materials well known in the art for the mirror head. Conventionally toothbrushes handles are made of plastic materials which are well known in the art. Environmentally safe materials are preferred. The heads may also be conformed in a variety of shapes and configurations. For instance the brushhead is preferably rectangular or oval in shape and preferably has 3 to 6 rows of bristles.

For the regular routine dental care that the majority of users of this system will encounter, the preferred technique for cleaning is the using of short circular strokes at the base line of the teeth and gums with a sweeping motion upwardly for the lower teeth and a similar motion with the sweeping downwardly for the upper teeth. For the biting surfaces of the teeth, they should be scrubbed normally with short strokes. It should be noted that in the brushing operation, there should not be a great deal of pressure applied to the teeth or gum by the brush and the brushing should be performed after every meal ideally but at a minimum in the morning after breakfast and at night after dinner but before retiring to bed.

Figure 6:
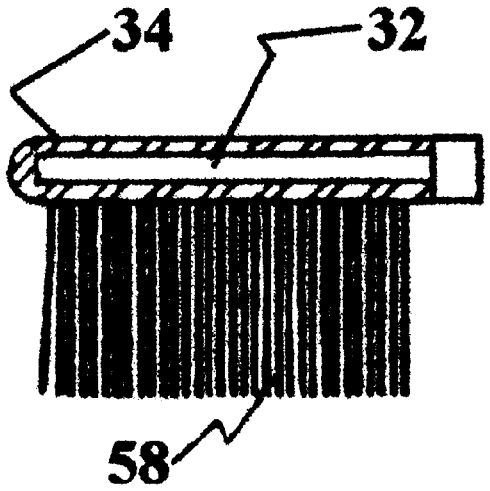
FIG. 6 is a cutaway side view of the brushhead, illustrating the recessed elongated cavity of the present invention.

FIG. 6 is a cutaway side view of the brushhead 34, illustrating brushhead bristles 58 and recessed elongated cavity 32 of the present invention.

Figure 7:
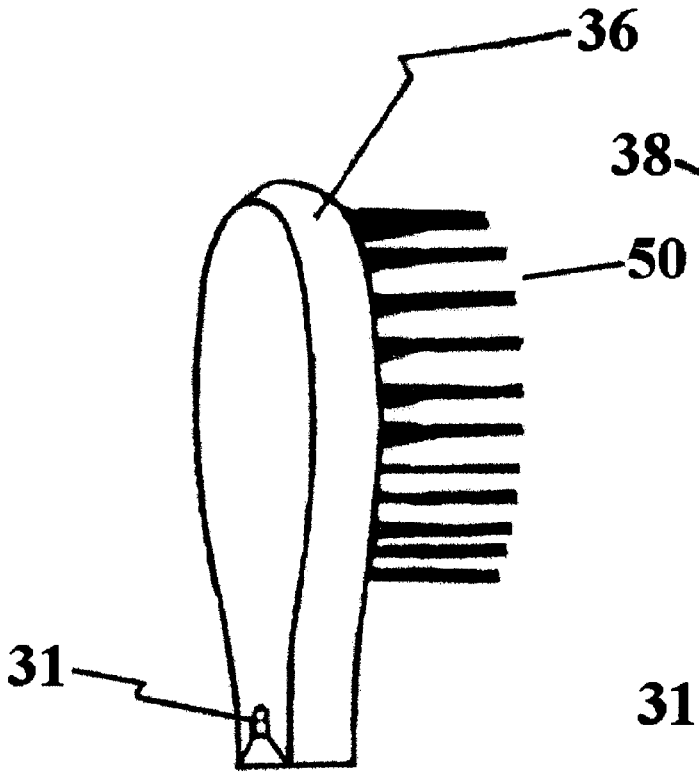
FIG. 7 is a side view of the tongue cleaner of the present invention.
Figure 8:
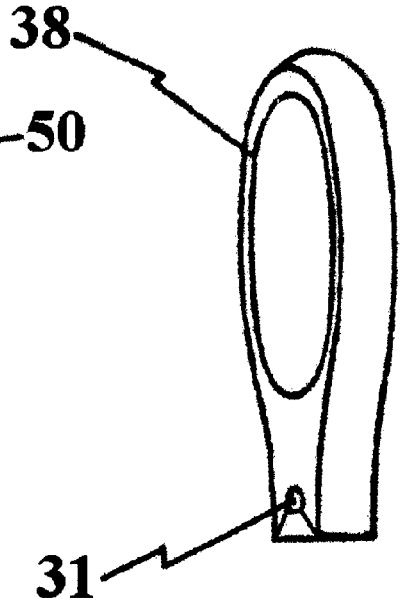
FIG. 8 is a side view of the mirror head of the present invention.

FIG. 7 is a side view of the tongue cleaner head 36 of the present invention. Halitosis affects approximately 25% of the U.S. population. Current thinking is that most breath-disorder problems come from the mouth. This results due to anaerobic bacteria breaking down protenaceous debris, which produce volatile sulfur compounds. Anaerobic bacteria hide deep in gingival pockets and tongue filaments because they can exist only in the absence of oxygen. The tongue is the starting point for bad breath. Impeccable oral hygiene is a must in order to eliminate halitosis. An important part of this hygiene is proper tongue cleaning.

Tongue cleaning alone can substantially reduce a person's bad breath, but is best used in conjunction with daily brushing and flossing. This tongue cleaner head 36 with rubber tips 50 is more desirable than a standard toothbrush because of its rubber tips 50. These tips 50 are used to clean and stimulate the papilla at the back of the tongue without gagging the user. The tongue cleaner head 36 with rubber tips 50 has a low profile design which enables the brush to reach the back ⅓ of the tongue comfortably. The tongue cleaner head 36 with rubber tips 50 removes plaque and bacteria that contributes to halitosis. The design adapts to the tongue contours removing the thick gelatinous coating on the tongue.

Figure 9B:
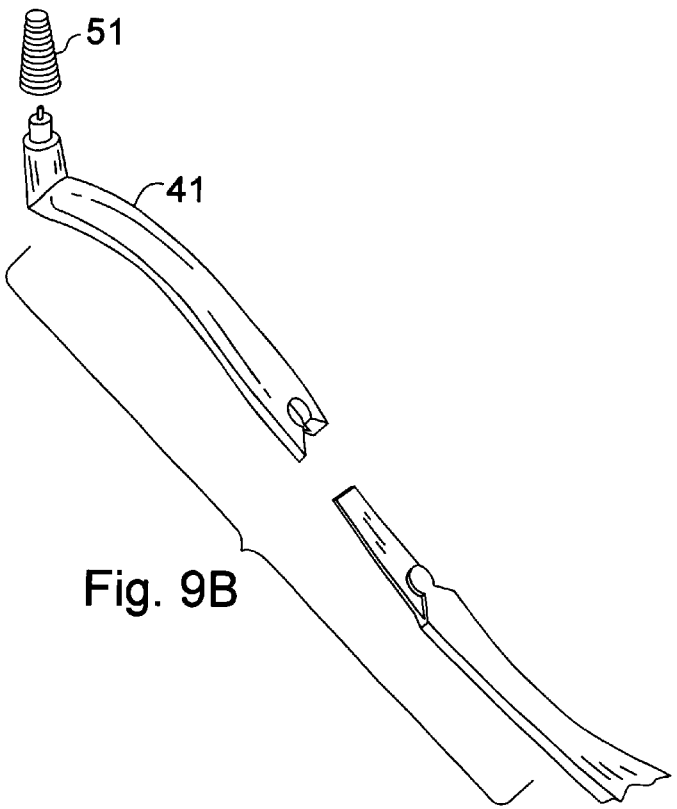
FIG. 9 is a side view of the interdental brush head of the present invention.
Figure 9A:
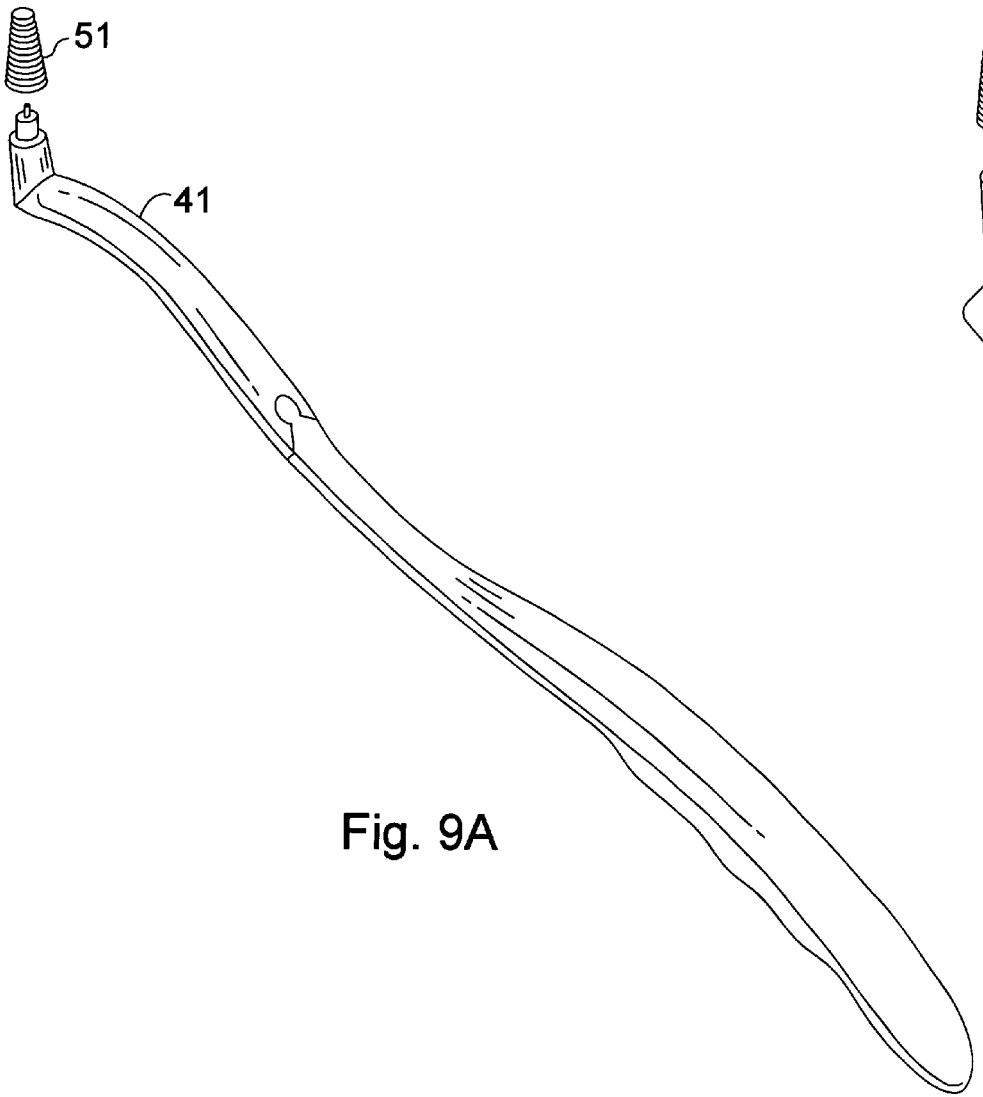

The specialized heads are further described and utilized as follows:

FIG. 9 illustrates the interdental brush head. The interdental brush head 41 has a nylon or plastic coating over a center wire 51 which prevents scratching of fixed bridges and implant titanium surfaces. It works by molding itself between crown and bridgework and if the space between the gum and prosthesis is large enough can go underneath the prosthesis.

The interdental brush head 41 helps prevent diseases caused by interdental spaces for all users, even with those with tight contacts. It will provide for complete atraumatic plaque removal from the often concave interproximal surface and the depth of the interproximal sulcus, i.e. space between the tooth and the gum.

Figure 10B:
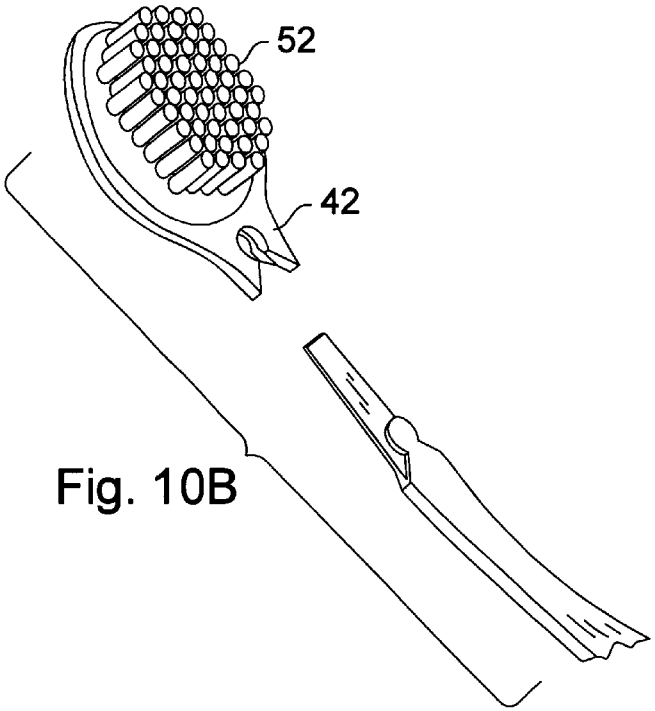
FIG. 10 is a side view of the oversize brush head of the present invention.
Figure 10A:
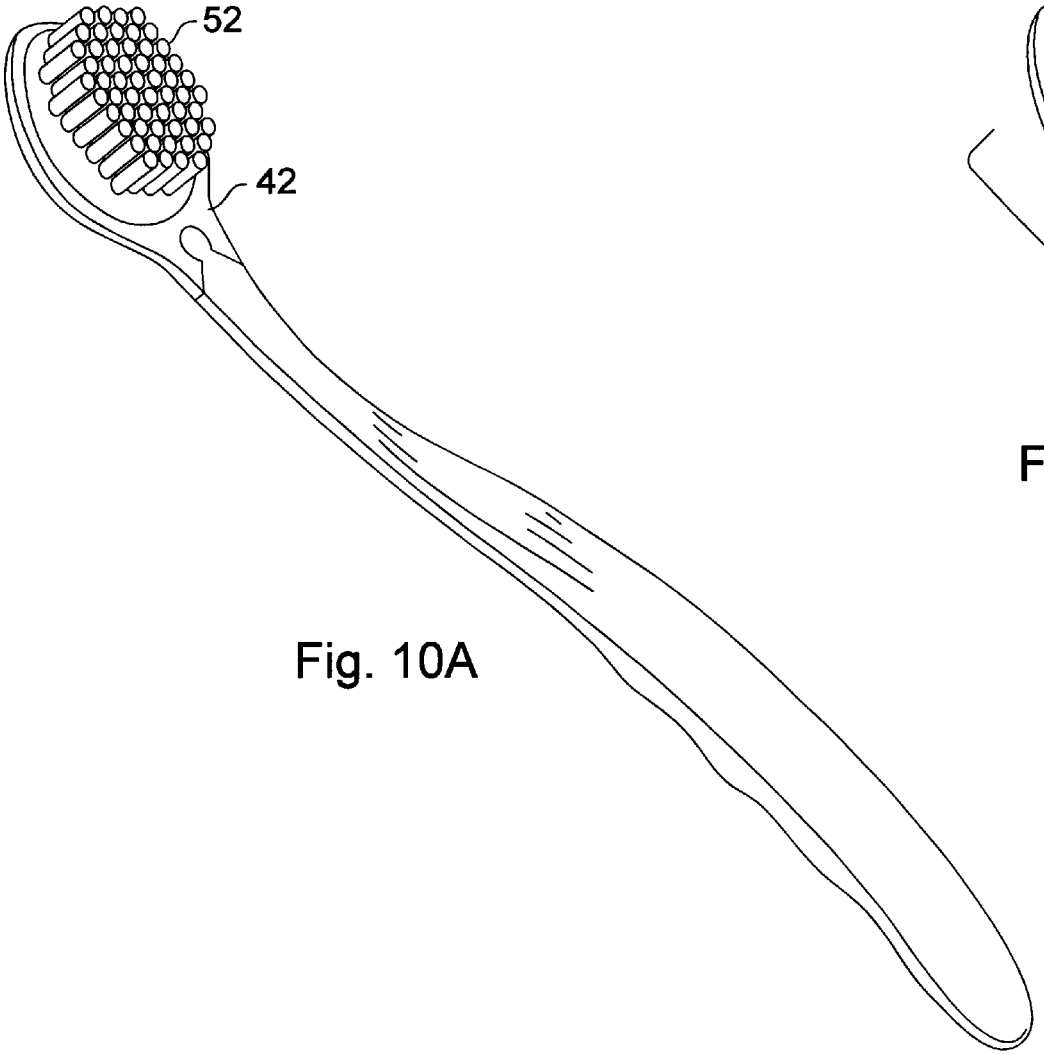

FIG. 10 illustrates the oversize brush head 42. Some people prefer a large head toothbrush as compared to a small or standard size head. This oversize brush head 42 has nylon bristles 52 which simultaneously overlap the teeth and gums. While brushing the teeth the oversize brush head 42 massages the gum tissue. It has the "can't miss" effect due to the increased surface area. This is the perfect toothbrush head for the hurried brusher.

Figure 11B:
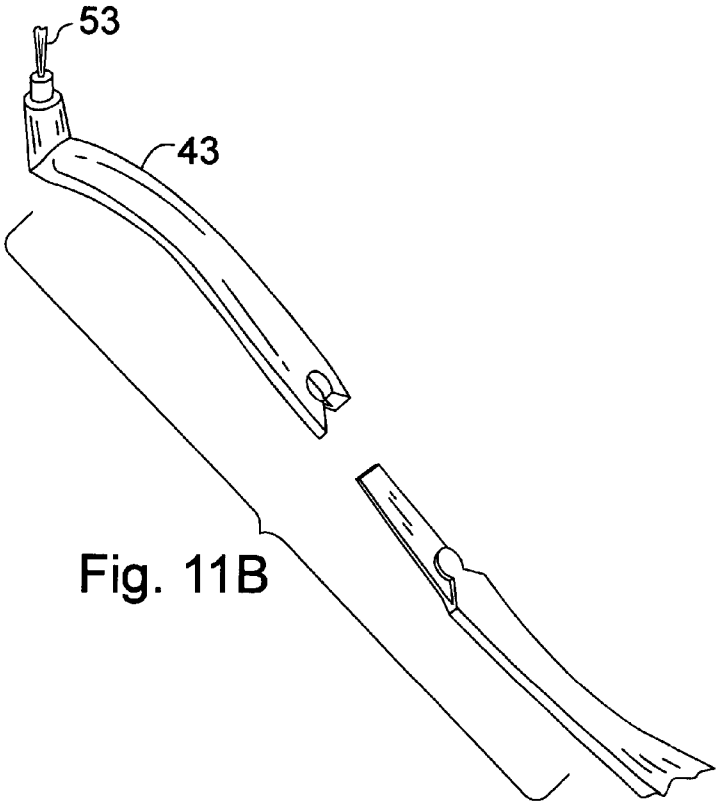
FIG. 11 is a side view of the implant brush head of the present invention.
Figure 11A:
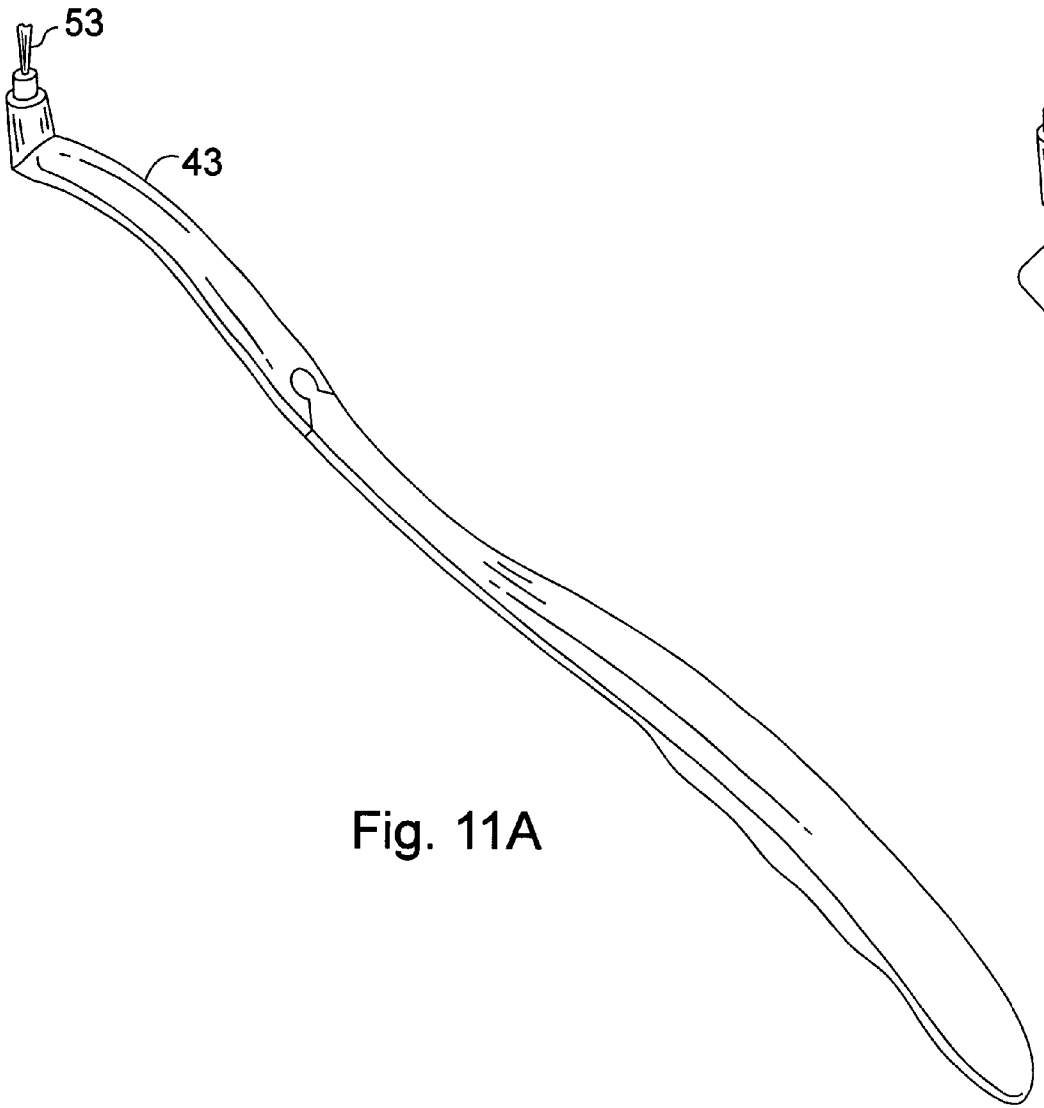

FIG. 11 illustrates the implant brush head. Maintaining healthy tissue in persons with implants requires plaque control aids. Evidence exists demonstrating that both implants and restorations which they support can fail in response to local etiological factors. These factors are in direct correlation to plaque accumulations. A person's plaque control performance is related to the amount of bone lost around the implants. The more bone loss the higher the risk for implant longevity. Most crucial to the success of an implant restoration is how effectively the person can maintain the oral environment.

The implant brush head 43 is an ideal plaque control aid. The implant brush head 43 is effective and easy to use. It offers good manual dexterity which enables ease of intraoral access. As a plaque control aid, users are directed to brush the cover screw of the implant, with the implant brush head dipped in chlorhexidine a chemotherapeutic agent. The local application of this chemotherapeutic agent is recommended because of its ability to reduce supracrevicular deposition of plaque. Secondly, if an abutment implant is readily accessible, the user can be instructed to brush, guiding the implant brush head bristles 53 into patient's peri-implant crevice. The peri-implant crevice is the area between the gingiva and implant. The paint brush like bristles 53 of the implant brush head 43 are soft and are designed to remove plaque from implant abutments without harming implant abutments which are made out of titanium and are easily scratched.

Figure 12C:
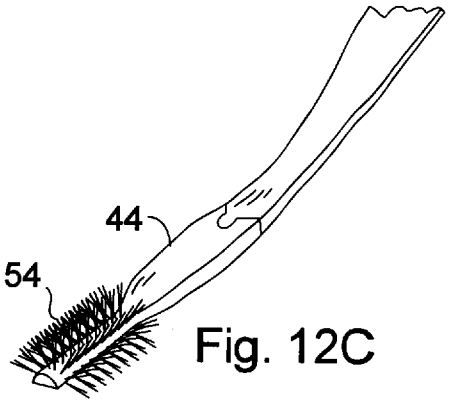
FIG. 12 is a side view of the gum brush head of the present invention.
Figure 12B:
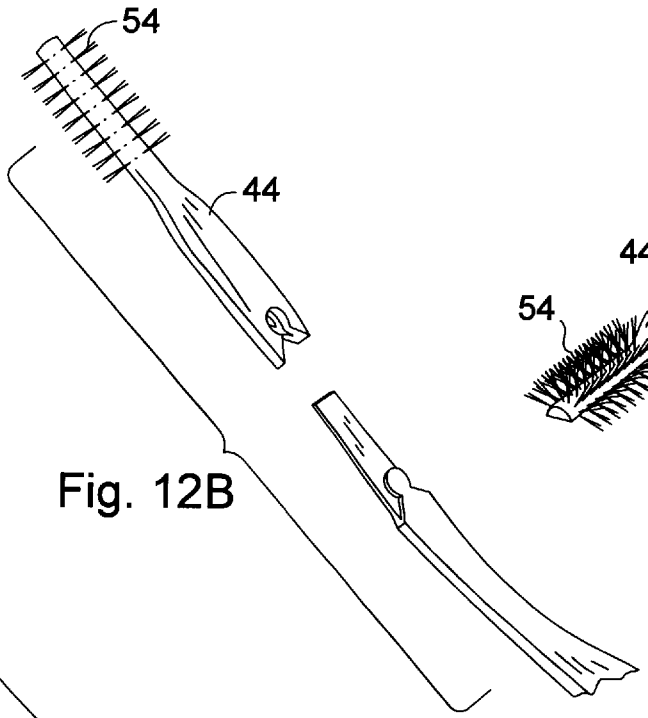
Figure 12A:
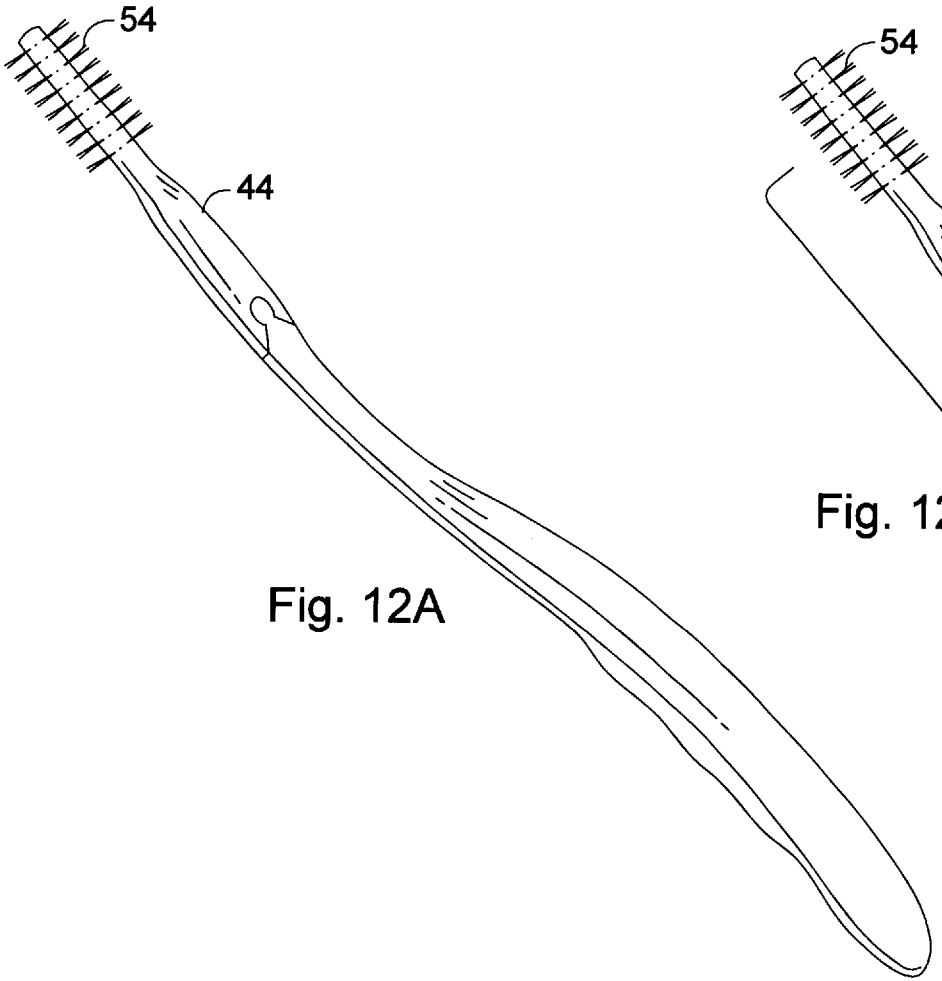

FIG. 12 illustrates the gum brush head. This gum brush head 44 has ultra soft nylon bristles 54 shaped as a fan. The fan design allows for a natural sweeping and clearing motion. The gum brush head 44 will clean all soft areas of the oral cavity, even delicate areas (palate, lip, and cheek). An ideal brush for the denture wearer, it will allow for the removal of films and debris from edentulous areas.

Figure 13C:
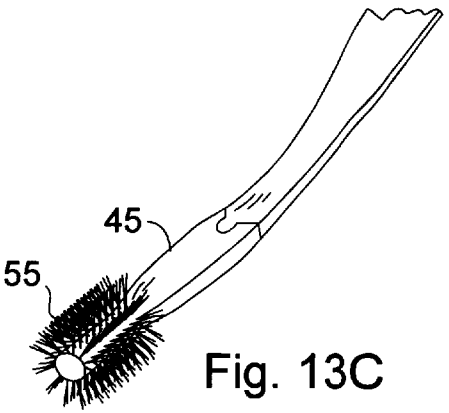
FIG. 13 is a side view of the denture brush head of the present invention.
Figure 13B:
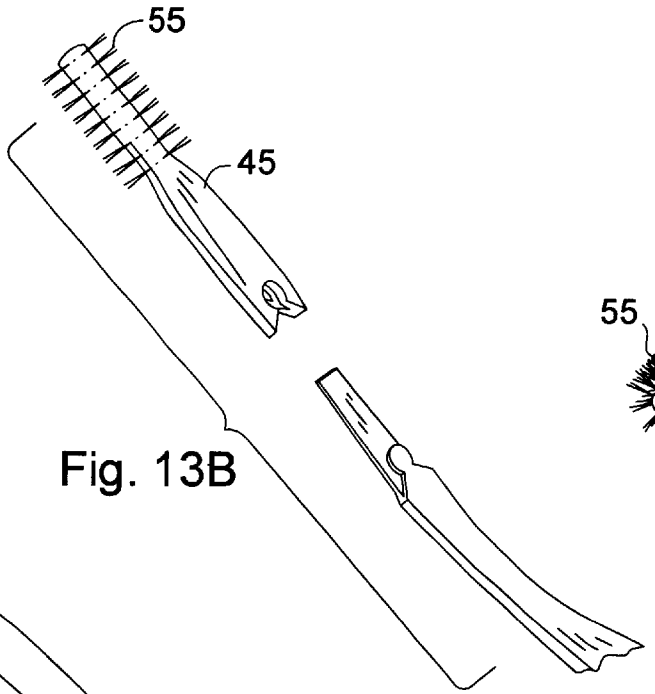
Figure 13A:
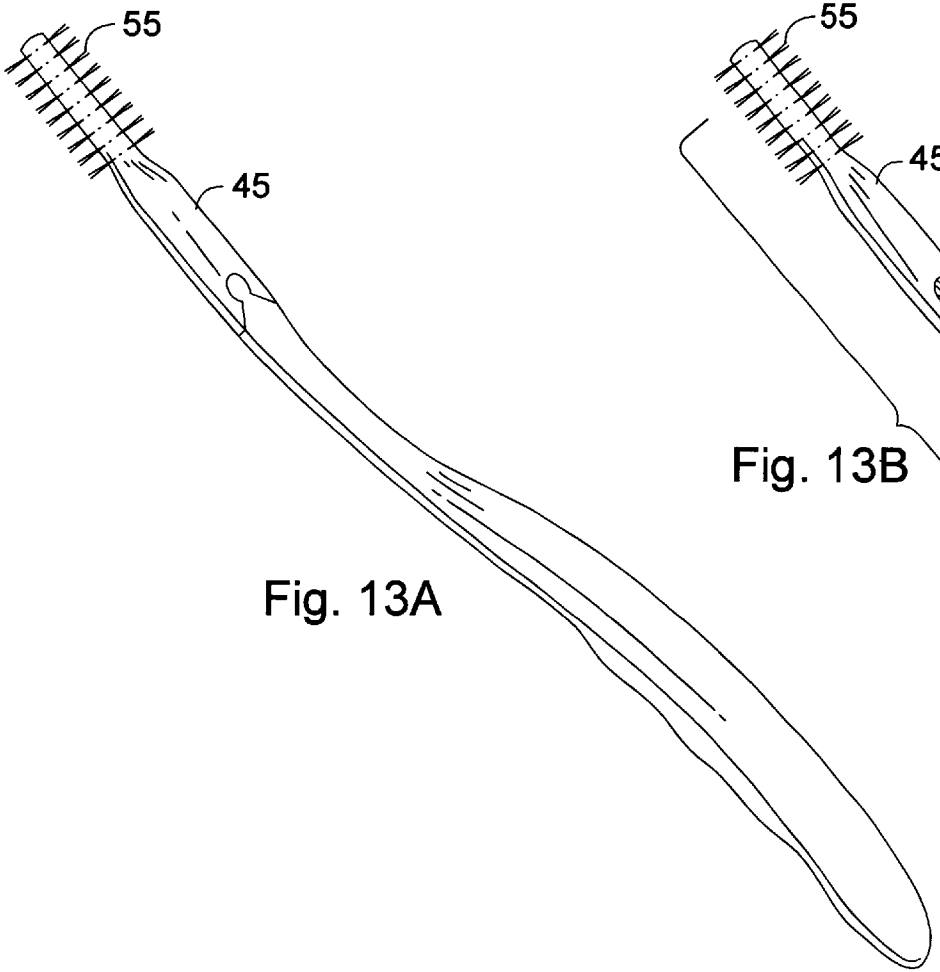

FIG. 13 illustrates the denture brush head. Oral hygiene of a denture user is just as important as a person with teeth. Denture cleanliness helps retard odors and bacteria of the underlying soft tissue.

The denture brush head 45 offers stiff nylon bristles 55 which can brush all surfaces of a denture prosthesis, including the underside. It loosens debris while removing odor causing stains. The denture brush head 45 offers denture users a practical and effective design, with a non-slip handle. The handle is specifically contoured for an easy grip, even by arthritic hands.

Figure 14B:
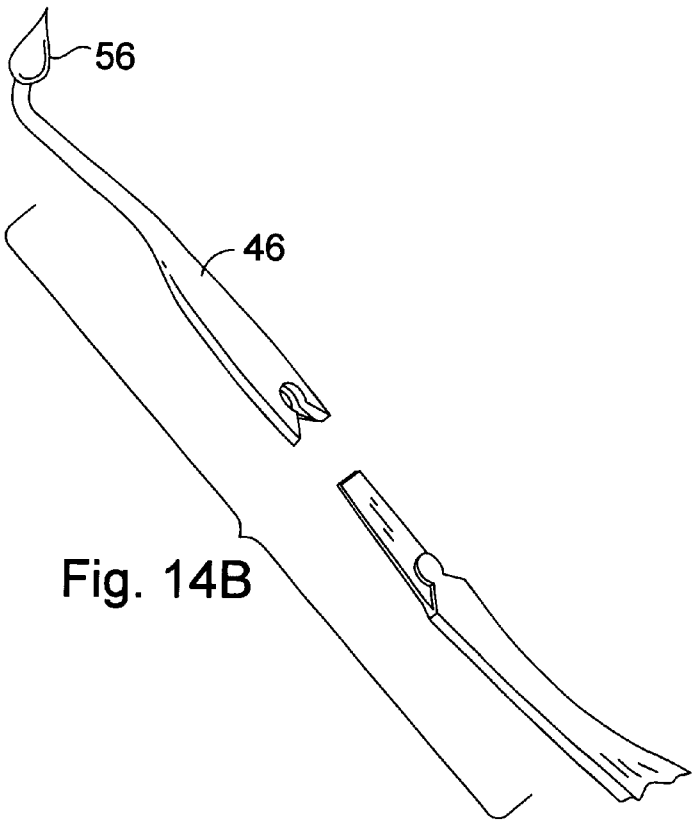
FIG. 14 is a side view of the gum stimuli head of the present invention.
Figure 14A:
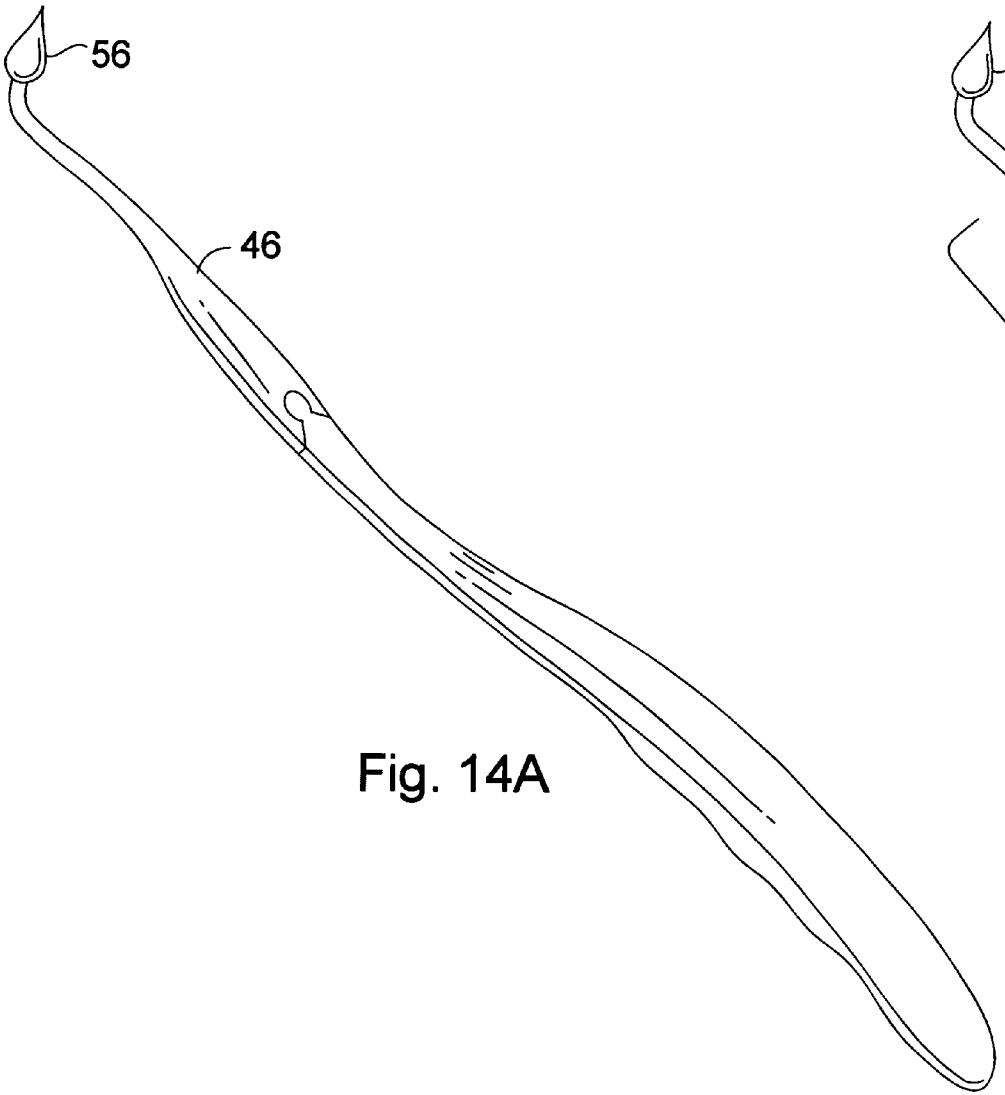

FIG. 14 illustrates the gum stimuli head. Periodontal health is essential in the overall care of the oral cavity. Therapeutic massage is important in maintaining healthy gingival tissue. Gingival stimulation increases healing properties and helps retard disease. The gum stimuli head 46 has a flexible soft rubber tip 56 that is ideal for the massage therapy of the gingival tissue.

The gum stimuli head 46 can also be used as a plaque control aid by removing soft debris above and below the tissue margin. This works due to the soft rubber tip 56 flexing and contouring itself with the anatomy of tooth and gum tissue.

Figure 15B:
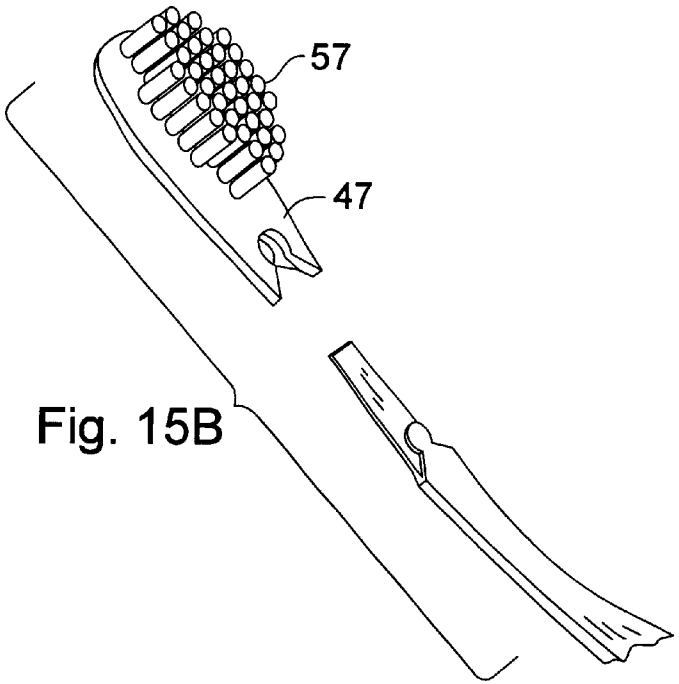
FIG. 15 is a side view of the ortho brush head of the present invention.
Figure 15A:
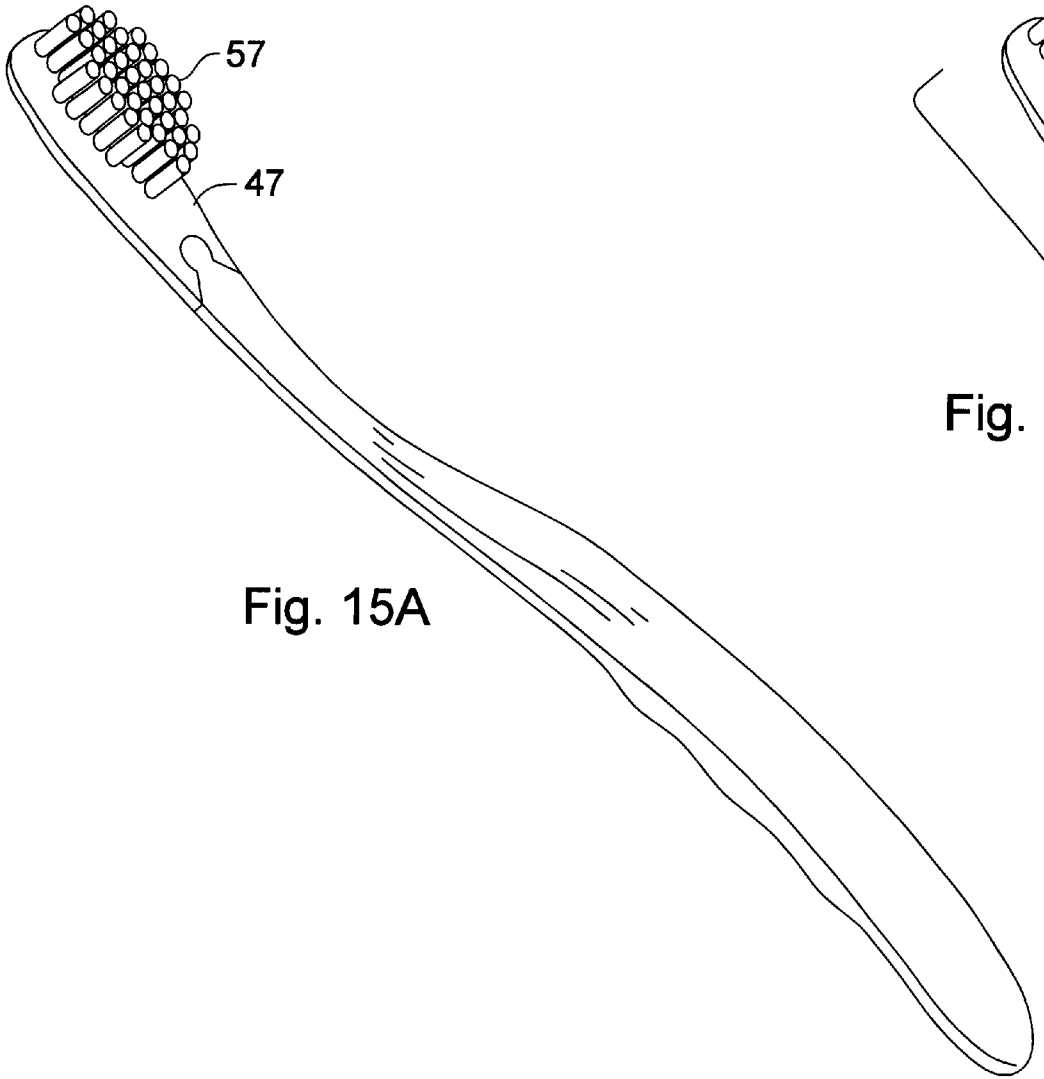

FIG. 15 illustrates the ortho brush head. Orthodontists require their patients to maintain a high level of oral hygiene. Ortho patients must brush harder and longer in order to remove debris that may be trapped in brackets, bands, elastics, wires and appliances.

This ortho brush head 47 has bilevel bristles 57 with raised outer bristles and low inner bristles. The raised outer bristles naturally sweep under ortho wires to remove debris. It also reaches over appliances to massage along the gumline. The lower inner bristles scrub occiusal surfaces clean and is able to fit in between ortho brackets. This ortho brush head 47 is designed for removing plaque, food and particles from teeth, braces and appliances.

There is an increasing concern in our society which relates to bacterial contamination. The present invention with a disposable head encourages the user to dispose of the head more frequently, without throwing away the entire toothbrush. Some heads can be made to turn colors or self destruct when it is time for replacement. The replacing merely of the heads can be done economically, since only one portion of the toothbrush is being replaced. Also, since only a small portion of the toothbrush is being replaced at one time, this system does not create a burden on the environment by wasting a great deal of material. Moreover, the present invention is preferably made from recyclable materials that also aids in protecting the environment.

Changes and modifications in the specifically described embodiments can be carried out without departing from the scope of the invention which is intended to be limited only by the scope of the appended claims.

What is claimed:

1. A toothbrush having interchangeable, detachable, disposable heads Comprising a) an ergonomically shaped handle with a curvature therein to conform with curvature of a user's hand, with a neck end and a butt end, a front side and a back side, where the neck end tapers into an elongated stem on the front and back sides of the handle, a distance from the stem a locking nodule is located integrated with stopping means, said locking nodule having a round front element, and along the curvature of the back side of the handle a rubber gripping means with undulating ridges for securely holding the handle during its use, and b) an interchangeable head with a front side and back side where toothbrush bristles are located on the front side and as an integral part thereof a recessed, elongated cavity suitable for receiving and seating the tapered elongated stem therein to form a firm backbone support framework for the handle and locking slots on the front and back sides of the head for receiving and securing the locking nodules of the handle to the head.

2. The toothbrush of claim 1, wherein the curvature of the handle exists on 2 planes, a first plane which includes the stem and head and a second plane which includes the handle, wherein the curvature of the first plane slopes towards the bristles (or front side) of the toothbrush and a second plane which slopes away from the bristles (or front side) of the toothbrush.

3. The toothbrush of claim 2, wherein the gripping means has a plurality of ridges for seating the fingers of a user's hand in a wrapping around securing grip.

4. The toothbrush of claim 1, wherein the head has a rectangle shape with 3 or 6 rows of bristles therein.

5. The toothbrush of claim 1, wherein the head has an oval shape.

6. The toothbrush of claim 5, wherein the oval shaped head is oversized in order to be able to brush the gums and teeth at the same time.

7. The toothbrush of claim 1, wherein the head has a nylon or plastic coating over a center wire which prevents scratching of fixed bridges and implant titanium surfaces.

8. The toothbrush of claim 1, wherein the head has a soft long paint brush like bristles which remove plaque from implant abutments without harming implant abutment surfaces.

9. The toothbrush of claim 8, wherein the bristles are dipped in chlorhexidine before brushing.

10. The toothbrush of claim 1, wherein the head has soft nylon bristles shaped like a fan in order to provide a natural sweeping and clearing motion to clean soft areas of the oral cavity such as the palate, lip and cheek.

11. The toothbrush of claim 1, wherein the head has stiff nylon bristles as a means for brushing surfaces of a denture prosthesis including underside of the prosthesis.

12. The toothbrush of claim 1, wherein the head has a soft rubber tip in order to massage gingival tissue and remove soft debris above and below tissue margin by flexing and contouring itself with anatomy of tooth and gum tissue.

13. The toothbrush of claim 1, wherein the head has shorter bristles on inside rows and longer bristles on outside rows in order to brush around teeth braces.

14. An oral care system having the toothbrush of claim 1 and at least two other interchangeable heads of a mirror head and a tongue cleaner head.

15. An oral care system having the toothbrush of claim 1 and at least two other interchangeable heads selected from the group consisting of tongue cleaner head, mirror head, interdental brush head, oversize brush head, implant brush head, gum brush head, denture brush head, gum stimuli head, and ortho brush head.

16. An oral care system according to claim 15 having the toothbrush of claim 1 and at least three other interchangeable heads selected from the group consisting of tongue cleaner head, mirror head, interdental brush head, oversize brush head, implant brush head, gum brush head, denture brush head, gum stimuli head, and ortho brush head.

* * * * *